US006149043A

United States Patent [19]

Goto

[11] Patent Number: 6,149,043

[45] **Date of Patent: *Nov. 21, 2000**

[54] HOLDER FOR ELECTRONIC DEVICE

[75] Inventor: Seiichiro Goto, Shizuoka, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/141,325

[22] Filed: Aug. 27, 1998

[30] Foreign Application Priority Data

Aug. 27, 1997 [JP] Japan ..... 9-231397

[51] Int. Cl.[7] ..... A45F 5/00

[52] U.S. Cl. ..... 224/669; 224/272; 224/930; 24/3.11; 24/499; 24/511

[58] Field of Search ..... 224/660, 666, 224/667, 668, 669, 670, 247, 269, 271, 272, 930; 24/3.7, 3.11, 3.12, 499, 500, 509, 511; 455/100, 351; 379/455

[56] References Cited

U.S. PATENT DOCUMENTS

| | | | |
|---|---|---|---|
| 4,100,653 | 7/1978 | Sensabaugh | 224/669 X |
| 4,145,793 | 3/1979 | Berlet | 24/511 X |
| 4,277,863 | 7/1981 | Faneuf | 224/247 X |
| 4,536,925 | 8/1985 | Boothe et al. | 455/351 X |
| 4,722,120 | 2/1988 | Lu | 24/499 X |
| 4,741,074 | 5/1988 | Budano, II et al. | 224/269 X |
| 4,780,934 | 11/1988 | Vickers et al. | 224/670 X |
| 4,881,304 | 11/1989 | Colangelo | 24/511 |
| 4,987,659 | 1/1991 | Grandis | 24/499 |
| 5,016,326 | 5/1991 | Goldenberg | 224/269 X |
| 5,052,081 | 10/1991 | Fuehrer | 224/669 X |
| 5,081,709 | 1/1992 | Benyo et al. | 224/669 X |
| 5,185,906 | 2/1993 | Brooks | 224/669 X |
| 5,261,583 | 11/1993 | Loug et al. | 224/667 X |
| 5,325,570 | 7/1994 | Chin-Ho | 24/511 X |
| 5,356,060 | 10/1994 | Kuroda | 224/252 |
| 5,379,490 | 1/1995 | Wandt et al. | 24/3 |
| 5,385,282 | 1/1995 | Chen | 224/669 |
| 5,414,596 | 5/1995 | Eaton et al. | 455/351 X |
| 5,528,770 | 6/1996 | Castilla et al. | 224/667 X |
| 5,613,236 | 3/1997 | Tajima et al. | 224/269 X |
| 5,640,742 | 6/1997 | White et al. | 24/3.12 |
| 5,678,281 | 10/1997 | Kamp et al. | 24/3.11 |
| 5,755,367 | 5/1998 | Yamada | 224/666 X |
| 5,806,146 | 9/1998 | Chen | 24/3.11 |
| 5,829,102 | 11/1998 | Conti | 24/3.11 X |

FOREIGN PATENT DOCUMENTS

| | | |
|---|---|---|
| 61-34775 | 3/1986 | Japan . |
| 62-47176 | 3/1987 | Japan . |
| 3-36173 | 4/1991 | Japan . |
| 5-55945 | 3/1993 | Japan . |

*Primary Examiner*—Gregory M. Vidovich
*Attorney, Agent, or Firm*—Sughrue, Mion, Zinn, Macpeak & Seas, PLLC

[57] ABSTRACT

Disclosed is a holder for an electronic device used in carrying a small electronic device while attaching it to a wearing belt or cloth, the holder having: a base provided with one surface for holding the electronic device and another surface including bearing parts and a flexible springy movable part; and a clip provided with rotation shafts to be fitted into the bearing parts and a concave part to be engaged with a tip of the flexible springy movable part.

7 Claims, 5 Drawing Sheets

HOLDER FOR ELECTRONIC DEVICE

FIELD OF THE INVENTION

This invention relates to a holder for an electronic device, and more particularly to, a holder used in carrying an electronic device while attaching it to a belt etc.

BACKGROUND OF THE INVENTION

A conventional holder for electronic device is disclosed in Japanese Utility Model laid-open No.03-D36173 (1991). The holder comprises a holder main body for holding an electronic device and a flexible clip that is of synthetic resin and is molded with fulcrum shafts. The clip is detachably engaged to the holder main body by fitting its fulcrum shafts into shaft holes provided on the holder main body. In use, the clip is bent: to increase the clearance between the holder main body and the clip, then inserted to sandwich a cloth end or a belt between the holder main body and the clip.

Thus, the conventional holder uses the spring force of the clip to energize the clipping force. However, the rigidity of the clip itself has to be reduced to facilitate the bending of the clip in use. Accordingly, it is difficult for the conventional holder to satisfy both easiness in attaching/detaching and high clipping force.

Also, when only the holder main body is used detaching the clip, a protruded mounting base provided on the holder main body to mount the clip on the holder main body becomes an obstacle in putting it into a pocket or a bag.

SUMMARY OF THE INVENTION

Accordingly, it is an object of the invention to provide a holder for an electronic device that satisfies both easiness in attaching/detaching and high clipping force.

According to the invention, a holder for an electronic device used in carrying a small electronic device while attaching it to a wearing belt or cloth, comprises:

- a base provided with one surface for holding the electronic device and another surface including bearing parts and a flexible springy movable part; and
- a clip provided with rotation shafts to be fitted into the bearing parts and a concave part: to be engaged with a tip of the flexible springy movable part.

BRIEF DESCRIPTION OF THE DRAWINGS

The invention will be explained in more detail in conjunction with the appended drawings, wherein.

DESCRIPTION OF THE PREFERRED EMBODIMENTS

Figure 1:
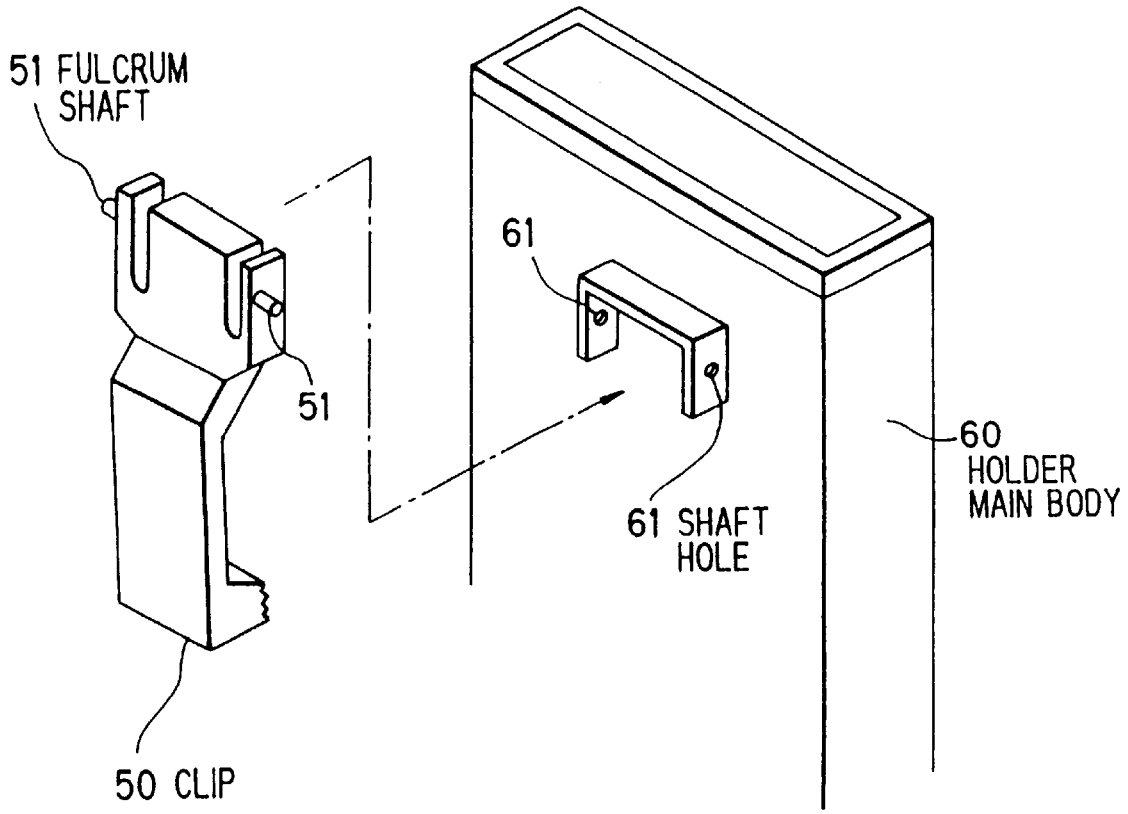
FIG. 1 PRIOR ART
FIG. 1 is a broken perspective view showing a conventional holder.

Before explaining a holder for an electronic device in the preferred embodiments, the aforementioned conventional holder for an electronic device will be explained in FIG. 1.

As shown, the holder comprises a holder main body 60 for holding an electronic device and a flexible clip 50 that is of synthetic resin and is molded with fulcrum shafts 51. The clip 50 is detachably engaged to the holder main body 60 by fitting its fulcrum shafts 51 into shaft holes 61 provided on the holder main body 60. In use, the clip 50 is bent to increase the clearance between the holder main body and the clip 50, then inserted to sandwich a cloth end or a belt between the holder main body and the clip 50.

Figure 2:
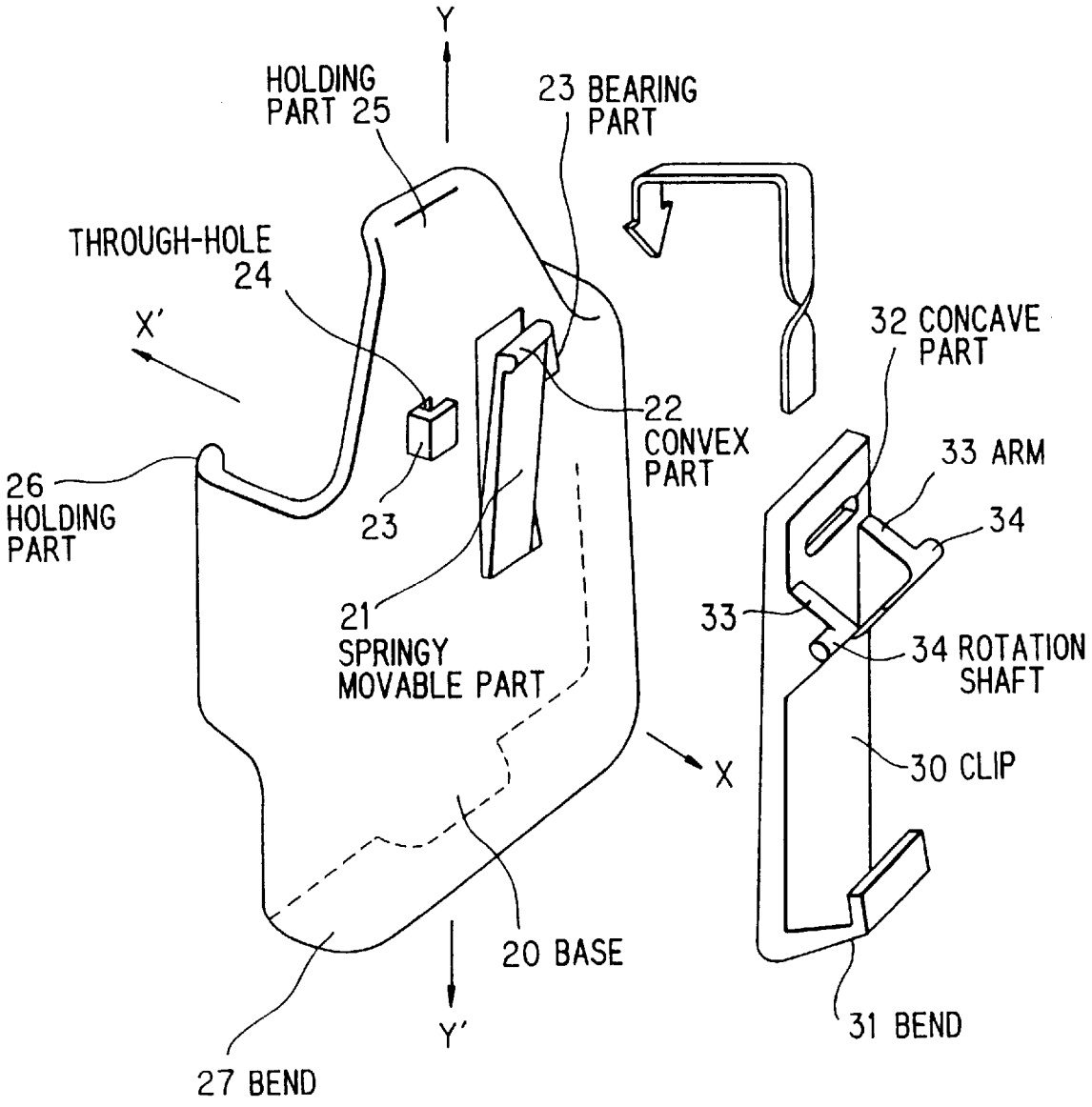
FIG. 2 is a broken perspective view showing a holder for an electronic device in a first preferred embodiment according to the invention.
Figure 3:
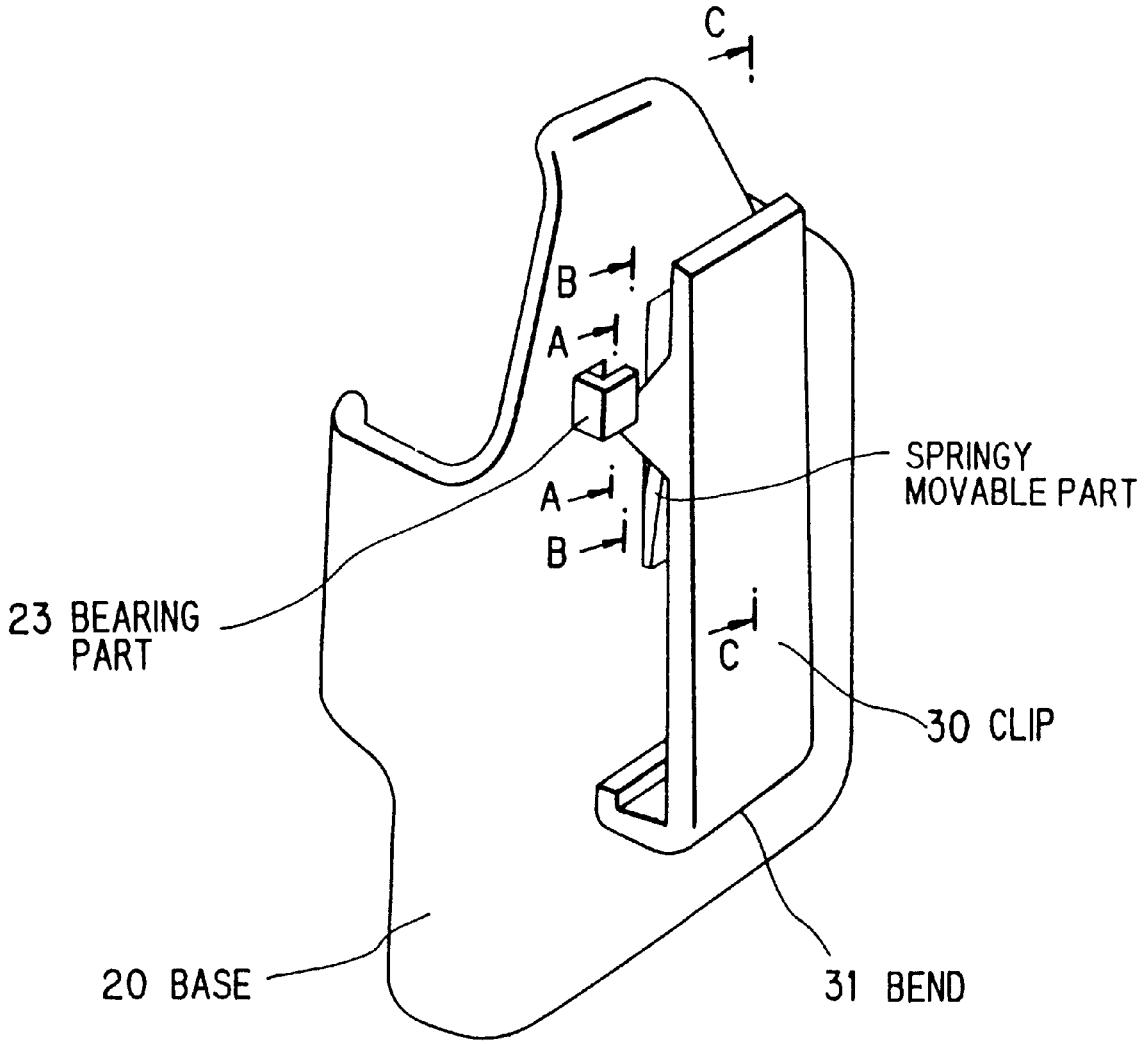
FIG. 3 is a perspective view showing the holder of the first embodiment in the state that a clip is mounted on a base.
Figure 4A:
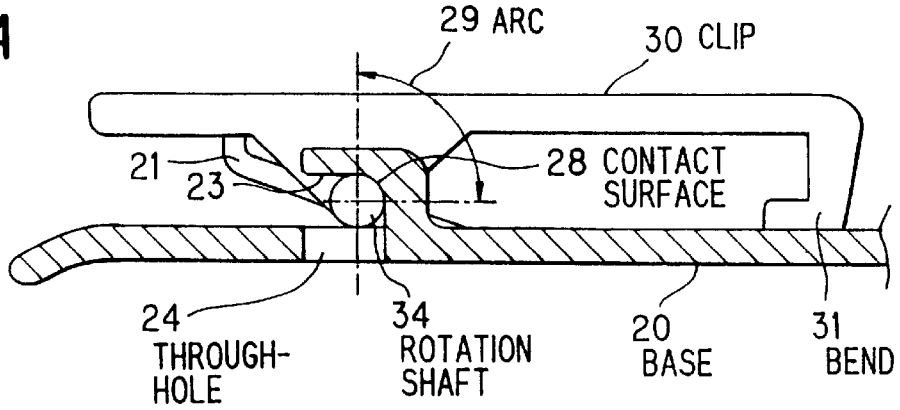
FIGS. 4A to 4D are cross sectional views showing engagement relationships between the base and clip in FIG. 3.
Figure 4B:
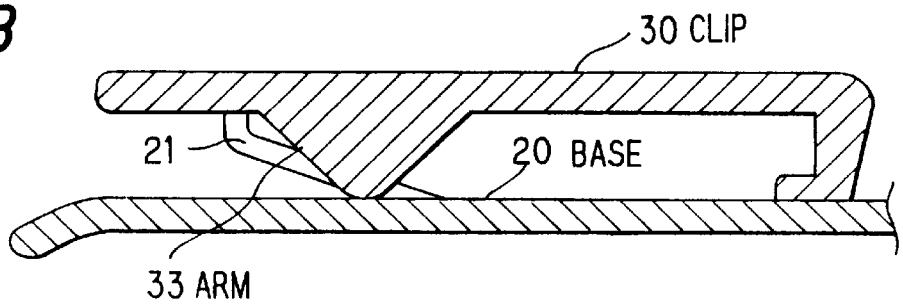
Figure 4C:
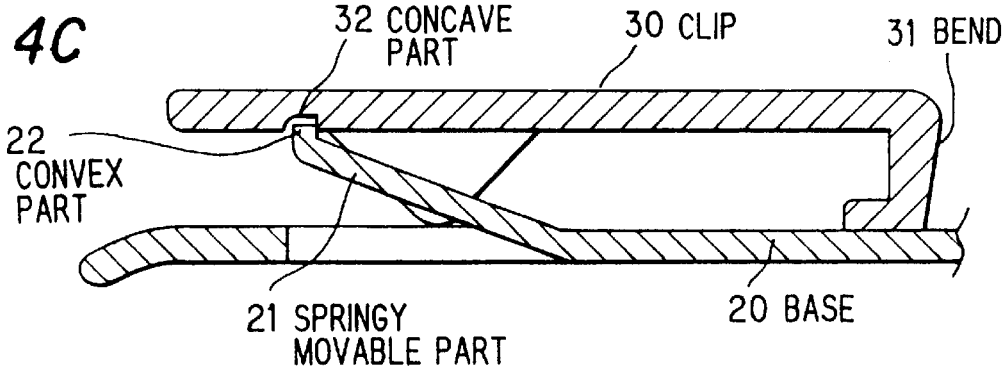
Figure 4D:
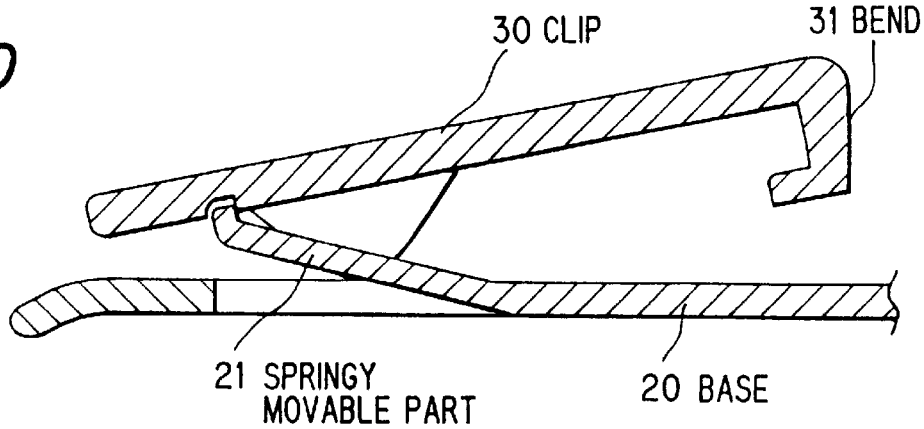
Figure 6:
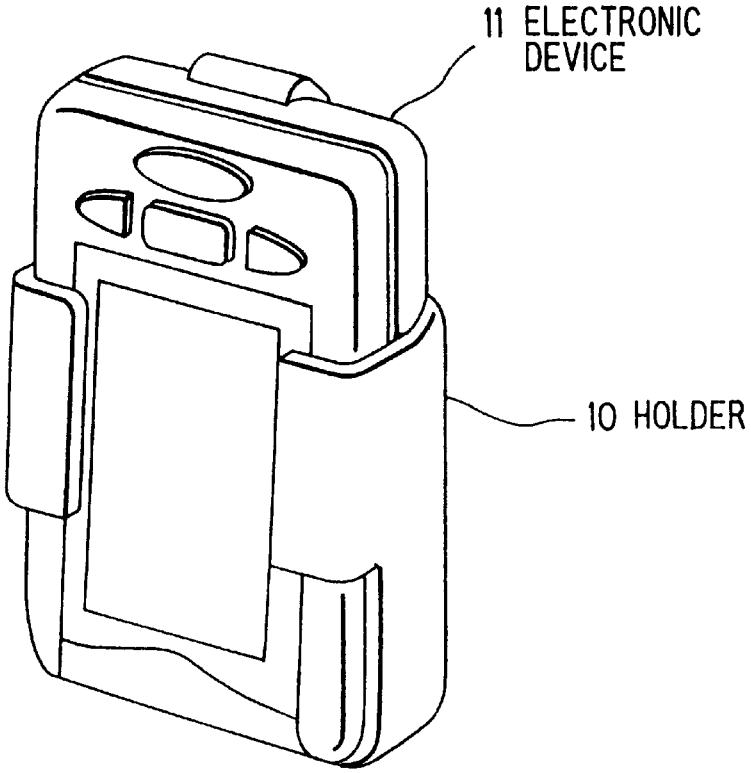
FIG. 6 is a perspective view showing the state that an electronic device is held by the holder of the first or second embodiment.

Next, a holder for an electronic device in the first preferred embodiment will be explained in FIGS. 2, 3, 4A to 4D and 6. FIG. 2 is a broken perspective view showing a holder in the first embodiment, where a clip 30 is separated from a base 20 and is shown turned inside out. FIG. 3 is a perspective view showing the state that the clip 30 is attached to the base 20. FIGS. 4A to 4D are cross sectional views showing the engaging states between the base 20 and the clip 30. Meanwhile, FIG. 4A is a cross sectional view cut along the line A—A in FIG. 3, FIG. 4B is a cross sectional view cut along the line B—B in FIG. 3, and FIGS. 4C and 4D are cross sectional views cut along the line C—C in FIG. 3. FIG. 6 is a perspective view showing the state that the holder in the first embodiment is attached to an electronic device 11.

The holder in the first embodiment, as shown in FIG. 2, comprises the base 20 by which an electronic device can be easily detachably held and the clip 30 that can be easily attached to the base 20.

The clip 30, which has a rectangular form, is provided with a bend 31 on its one end in the longitudinal direction, a concave part 32 with a predetermined length and depth to be formed in the lateral direction, a pair of arms 33 with symmetrical mountain shapes to be formed on both ends in the lateral direction, and cylindrical rotation shafts 34 that are formed symmetrically and coaxially protruding by a predetermined length from the tips of the arms 33 in the lateral direction.

The base 20 is provided with a flexible springy movable part 21 to energize the clip 30 and bearing parts 23 to hold the rotation shafts 34 at the upper part of its clip-mounting surface, provided with a bend 27 to prevent an electronic device from falling at its bottom, provided with holding parts 25, 26 to hold the electronic device at its top and both sides, respectively.

The holder is assembled by sliding and inserting the rotation shafts 34 of the clip 30 (while pressing the clip 30 against the base 20) into the bearing parts 23 of the base 20 until a convex part 22 (i.e., bent part) formed on the end of the springy movable part 21 of the base 20 is fitted in and engaged with the concave part 32 of the clip 30.

The bearing part 23 is provided with a through-hole 24 on the side of the base 20 so as not to cause an undercut state in molding. When the clip 30 is mounted on the base 20, a contact surface 28 of the rotation shaft 34 with the bearing part 23, as shown in FIG. 4A, becomes a quarter of the circumference of the rotation shaft 34. Thus, the rotation shaft 34 contacts the bearing part 23 in the range of an arc 29.

Meanwhile, the base 20 is formed using cutting dies (male/female dies) in the direction of arrows X, X' (FIG. 2) and using a cutting die (slide die) in the direction of arrows Y, Y' (FIG. 2) to form the holding part 26. Thus, the bearing part 23 is formed using the cutting dies in the direction of the arrows X, X'.

An electronic device can be inserted into the holder while pressing and bending the holding part 25 at the top of the base 20. The base 20 can be easily bent in inserting the electronic device because it is made of a flexible material, e.g., synthetic resin.

In mounting the clip 30 on the base 20, the rotation shaft 34 of the clip 30 is fitted into the bearing part 23 of the base 20 and then the clip 30 is slid in the longitudinal direction orthogonal to the rotation shafts 34 while pressing the clip 30. At this time, the springy movable part 21 interferes with the inner surface of the clip 30 and the tip portion is thereby bent to energize the clip 30.

This energizing forces presses the upper end of the clip, above the rotation shaft 34, and gives such tension that the lower end of the clip 30 is always pressed against the surface of the base 20. Thus, as shown in FIG. 4C, the bend 31 of the clip 30 abuts on the base 20.

Also, when the rotation shaft 34 of the clip 30 is fitted into the bearing part 23 of the base 20, the convex part 22 at the tip of the springy movable part 21 is fitted into and engaged with the concave part 32 of the clip 30.

Also, the energizing of the springy movable part 21 to the clip 30 is supported by the bearing part 23. Therefore, the clip 30 can be mounted on the base 20 only by applying force against frictional force in the direction of the arrow Y'.

Due to the engagement of the rotation shaft 34 with the bearing part 23, the movement of the clip 30 in the directions of the arrows X, X' and Y' is restricted. Adding to this restriction, due to the engagement of the convex part 22 at the tip of the springy movable part 21 with the concave part 32 of the clip 30, the movement of the clip 30 in the direction of the arrow Y is also restricted since the variation of the springy movable part 21 in the up and down (Y–Y') directions in bending is so small.

Therefore, after the clip 30 is mounted on the base 20, the center of the rotation shaft 34 of the clip 30 always coincides with the center of the bearing part 23. Thus, the clip 30 can conduct only the rotational movement, as shown in FIG. 4D.

Also, the engagement of the convex part 22 at the tip of the springy movable part 21 with the concave part 32 of the clip 30 can be kept unless the springy movable part 21 behind the clip 30 is intentionally bent. Namely, in the range of normal clipping operations, the clip 30 can be prevented from detaching from the base 20.

In attaching the holder to a belt, the clip 30 is raised against the tension to the clip 30, putting down the holder to sandwich the belt between the clip 30 and the base 20. Thereby, the holder with an electronic device can be attached to the belt. In detaching the holder from the belt, the clip 30 is raised against the tension to the clip 30, pulling up the holder from the belt.

Figure 5:
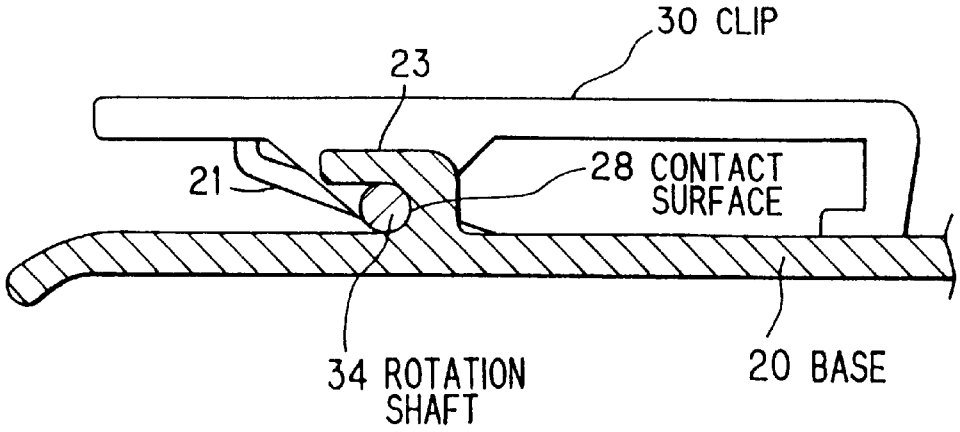
FIG. 5 is a cross sectional view showing a holder for an electronic device in a second preferred embodiment according to the invention.

Next, a holder for an electronic device in the second preferred embodiment according to the invention will be explained in FIG. 5 referring to FIGS. 2 and 3. FIG. 5 is a cross sectional view, which is cut along the line A—A as in FIG. 3, showing the engaging state of the rotation shaft 34 of the clip 30 with the bearing part 23 of the base 20. The second embodiment is different from the first embodiment only about the structure of the bearing part 23 of the base 20 and its molding method. Therefore, the explanations of the other common components are omitted herein.

In the first embodiment, the bearing part 23 of the base 20 can be formed using the cutting dies (male and female dies) not to make an undercut shape. However, in the second embodiment, an undercut shape can be formed using a slide die etc. as a cutting die. Thereby, the bearing part 23 can be formed into U-shaped in section, as shown in FIG. 5. Due to the U-shaped bearing part 23, the contact surface of the rotation shaft 34 with the bearing part 23, as shown in FIG. 5, becomes a half of the circumference of the rotation shaft 34. As a result, the restriction surface of the rotation shaft 34 can be increased, thereby smoothing the rotation of the clip 30.

As described above, in the first and second embodiments, the clip can conduct only the rotational movement around the rotation shafts on the base due to the engagement of the bearing parts with the rotation shafts and the engagement of the convex part of the flexible springy movable part with the concave part of the clip. Also, the energizing to the clip (clipping force) can be generated by the bending of the flexible springy movable part that occurs fulcruming one end of the flexible springy movable part connected with the base when the clip is mounted on the base, without using the spring force of the clip itself. Therefore, the rigidity of the clip itself can be considered separating from the spring force of the springy movable part. Both the clip-operating force (in opening/closing) and the clipping force can be designed to be optimum values. Thus, the holder of the embodiments can satisfy both easiness in attaching/detaching and high clipping force.

Also, the clip can be firmly held by the bearing parts against pulling force applied to the clip to separate from the base because the bearing parts have a bag-like shape formed connecting with the base.

Also, in the first embodiment, the bearing part can be formed by using only the male/female cutting dies, without using the slide die. The formation time is reduced by that much, and the cost of cutting dies can be reduced. Thus, the total manufacturing cost can be reduced.

Also, by only sliding and inserting the rotation shafts into the bearing parts of the base, the restriction to the rotation shafts, the energizing to the clip and the locking of the clip can be easily completed at the same time.

Although the invention has been described with respect to specific embodiment for complete and clear disclosure, the appended claims are not to be thus limited but are to be construed as embodying all modification and alternative constructions that may occur to one skilled in the art which fairly fall within the basic teaching here is set forth.

What is claimed is:

1. A holder for an electronic device used in carrying a small electronic device while attaching it to a wearing belt or cloth, comprising:

a base provided with one surface for holding said electronic device and another surface including bearing parts and a flexible springy movable part, said base and said bearing parts being immovably attached to each other, said springy movable part having a portion non-removably attached to said base; and a clip provided with rotation shafts to be fitted into said bearing parts and a concave part to be engaged with a tip of said flexible springy movable part, wherein said bearing parts include a pair of bearing parts and said rotation shafts include a pair of rotation shafts, said pair of bearing parts each being formed, in combination with the another surface of the base, in a U-shape having an open end for respectively slidingly receiving said pair of rotation shafts at said open end, wherein the U-shape is defined by the another surface of the base and the bearing part.

2. A holder for an electronic device, according to claim 1, wherein:

said flexible springy movable part has a substantially rectangular shape that includes, in the longitudinal direction, one end connected with said base and another end separated from said base, said another end being provided with said tip, wherein said tip has a bent portion that bends toward said concave part of said clip, wherein said flexible springy movable part energizes said clip by bending said one end connected with said base while said tip at said another end is engaged with said concave part of said clip.

3. A holder for an electronic device, according to claim 1, wherein:

said clip selectively rotates around said rotation shafts on said base by means of the engagement of said bearing parts with said rotation shafts and the engagement of the tip of said flexible springy movable part with said concave part of said clip.

4. A holder for an electronic device, according to claim 1, wherein:

each of said bearing parts of said base has an undercut form to be formed by a slide die and the undercut form is shaped so that each of said bearing parts has a contact surface which contacts one of the rotation shafts along only one-half the circumference of the rotation shaft.

5. The holder for an electronic device according to claim 1, wherein said flexible springy movable part is integrally formed with said base, so as to extend from said another surface of said base, and wherein said base is formed of a flexible material.

6. The holder for an electronic device according to claim 1, wherein, with respect to said flexible springy movable part, only said tip directly contacts said clip.

7. A holder for carrying a small electronic device while attaching the device to a wearing belt or cloth, comprising:

a base provided with one surface for holding said electronic device and another surface including bearing parts and a flexible springy movable part; and a clip provided with rotation shafts to be fitted into said bearing parts and a concave part to be engaged with a tip of said flexible springy movable part, wherein the another surface of said base has through holes formed therein adjacent to each of said bearing parts, so that only one-quarter of a circumference of each of said rotation shafts contacts a contact surface of each of said bearing parts and the remaining three-quarters of the circumference of each of said rotation shafts are free from contacting any portion of the holder.

* * * * *

UNITED STATES PATENT AND TRADEMARK OFFICE

CERTIFICATE OF CORRECTION

PATENT NO. : 6,149,043
DATED : November 21, 2000
INVENTOR(S) : Seiichiro Goto

It is certified that error appears in the above-identified patent and that said Letters Patent is hereby corrected as shown below:

Column 5,
Line 4, delete "bends" insert -- extending --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*